United States Patent [19]

Hahn

[11] Patent Number: 4,577,423

[45] Date of Patent: Mar. 25, 1986

[54] EXCAVATING TOOTH SYSTEM

[75] Inventor: Frederick C. Hahn, Aloha, Oreg.

[73] Assignee: ESCO Corporation, Portland, Oreg.

[21] Appl. No.: 685,336

[22] Filed: Dec. 24, 1984

[51] Int. Cl.[4] ..... E02F 9/28

[52] U.S. Cl. ..... 37/142 R; 172/753

[58] Field of Search ..... 37/141 R, 141 T, 142 R, 37/142 A; 172/753

[56] References Cited

U.S. PATENT DOCUMENTS

| | | | |
|---|---|---|---|
| 3,624,827 | 11/1971 | Liess et al. | 37/142 R |
| 4,103,442 | 8/1978 | Zepf | 37/142 R |
| 4,238,896 | 12/1980 | Lanz et al. | 37/141 R |
| 4,335,532 | 6/1982 | Hahn et al. | 37/142 R |

FOREIGN PATENT DOCUMENTS

| | | | |
|---|---|---|---|
| 2349025 | 4/1974 | Fed. Rep. of Germany | 37/141 T |

*Primary Examiner*—Edgar S. Burr
*Assistant Examiner*—Moshe I. Cohen
*Attorney, Agent, or Firm*—Tilton, Fallon, Lungmus & Chestnut

[57] ABSTRACT

An excavating tooth especially suited for trenching and the like wherein relatively smaller teeth are employed, the tooth incorporating a dual lock utilizing helical thread means and snap-in, detent-like means operative upon the conclusion of rotatable engagement of the tooth parts.

12 Claims, 16 Drawing Figures

FIG. 1
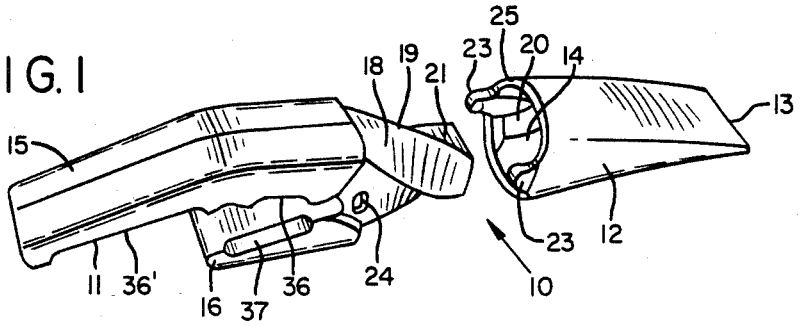
FIG. 2
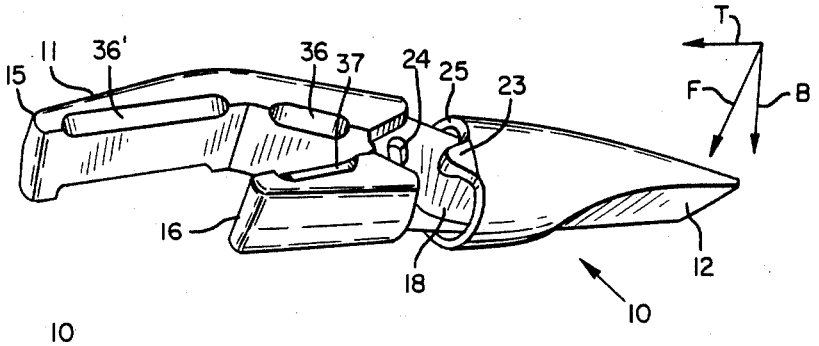
FIG. 3
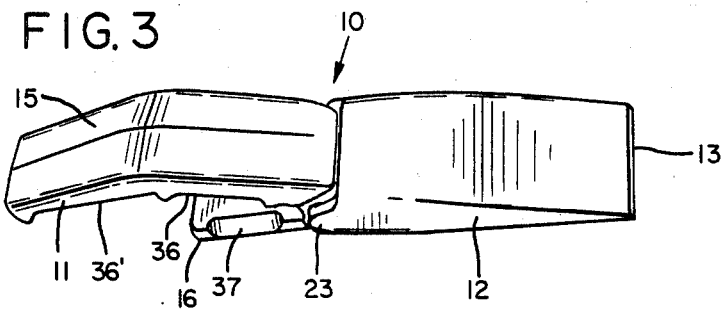
FIG. 4
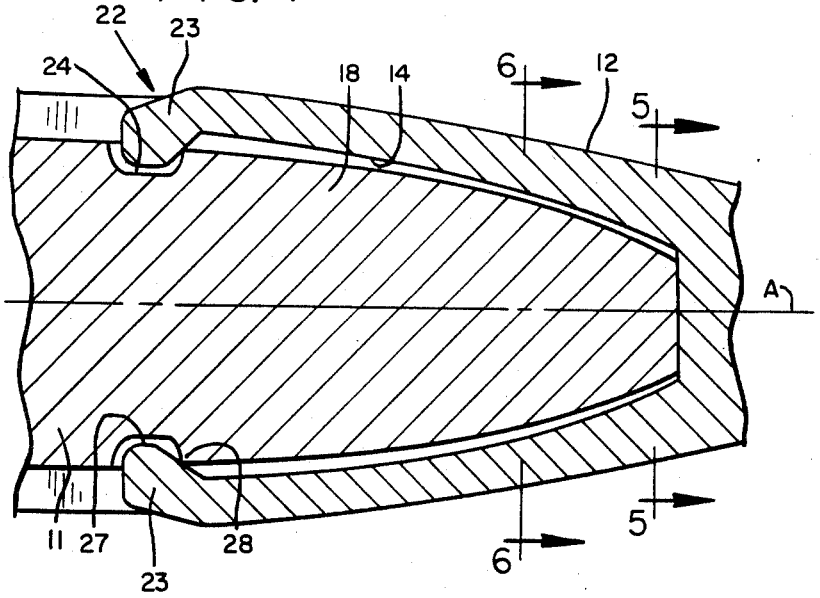
FIG. 5
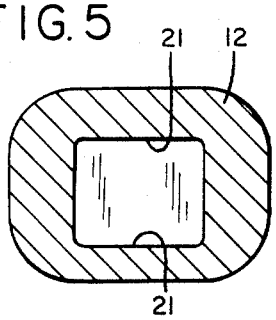
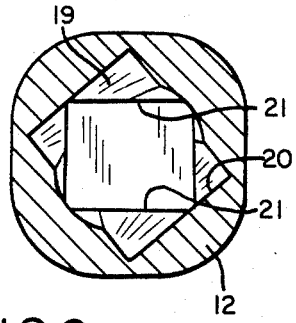
FIG. 6

FIG. 7
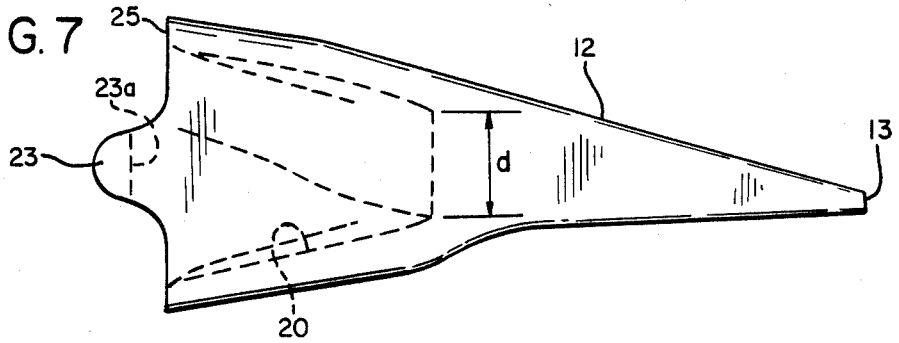
FIG. 8
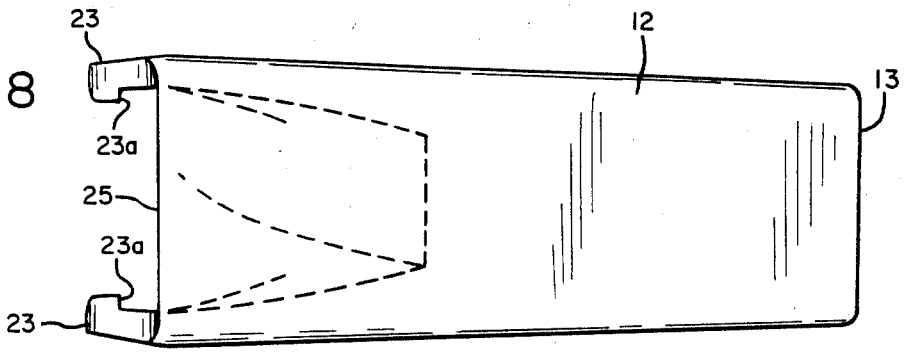
FIG. 9
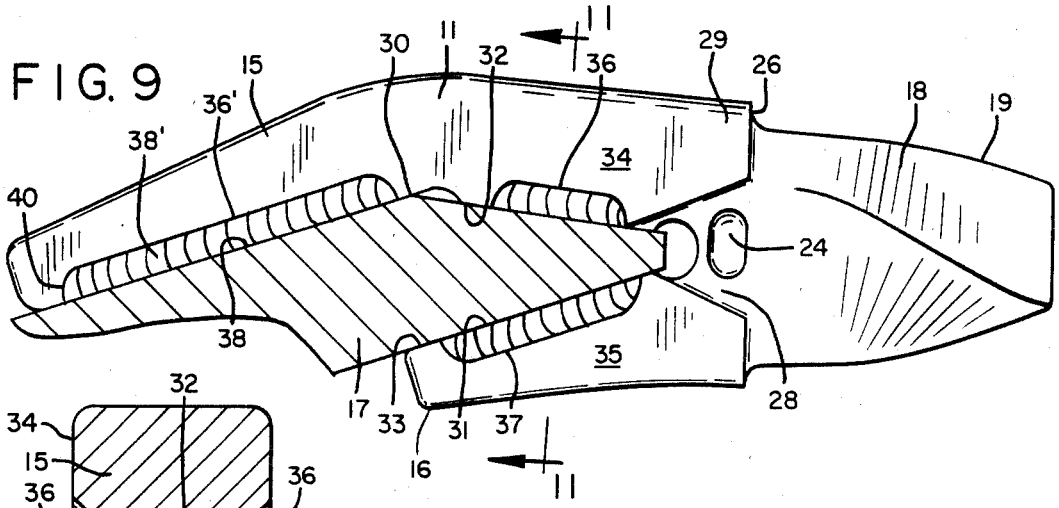
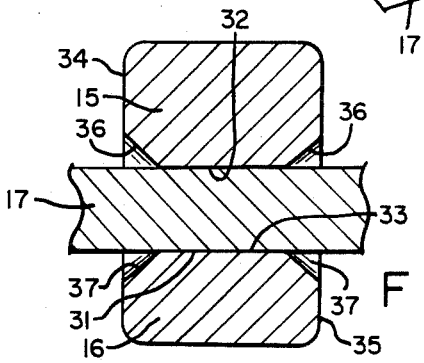
FIG. 11
FIG. 10
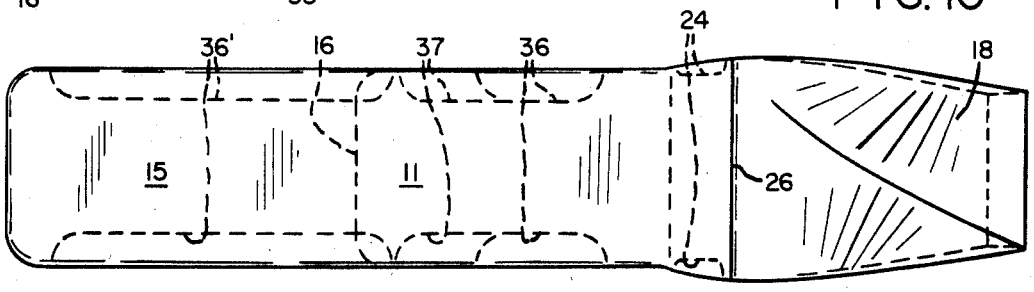

EXCAVATING TOOTH SYSTEM

This invention relates to an excavating tooth and, more particularly, embodying relatively small excavating teeth, with the smaller sizes often referred to as "trencher" teeth.

BACKGROUND AND SUMMARY OF INVENTION

Trencher teeth weigh generally in the range of about 5 to 10 pounds. These are installed on trencher machines and the buckets of small rubber tired and crawler tractors. Historically, these have been attached without the usual pin lock connecting the point and adapter. Instead, the adapter usually is equipped with a depression and the sidewalls of the point are heated and then deformed into a locking engagement with the adapter recess. It is not unusual for a changeover of points to take four hours, utilizing a welding truck to heat up the point. Normally, the welding truck comes out from the shop to go to the machine, then heats up the sides of the existing points whereupon the operator and his helper can drive them off. Thereafter, the new points are installed and after the sides are heated, they are dimple punches into the recesses in the adapter nose.

One effort to alleviate this time-consuming operation utilizing the welding truck is seen in co-owned U.S. Pat. No. 2,885,801 wherein the sides of the point were more malleable than the remainder of the point so as to facilitate dimpling. Nonetheless, vigorous manual labor was required for installation and removal. Another was to cast the dimples integrally with the hardened steel side walls, i.e., not using the malleable steel feature of the '801 patent. This was intended to provide a spring lock action. However, this did not perform satisfactorily inasmuch as negative thrust forces would pull the point off of its mounting adapter. Thereafter, the art uniformly has gone to the expedient of heating and peening the sides of the point into adapter recesses—to obtain a secure enough lock to avoid the unpredictable negative thrusts. For example, a stress tending to pull the point off the adapter may be encountered at any time the trencher moves rearwardly—as to position itself for a deeper cut. During this rearward movement, the point may become hooked on a rock, thus developing negative thrust.

The instant invention avoids all of the drawbacks of the prior art, particularly the deforming of point sides with its attendant hard physical labor by virtue of utilizing detent action in longitudinally extending tongues on the point or adapter cooperating with recesses in the companion element, viz., adapter or point, respectively, and in combination with helical thread means interconnecting the nose and socket of the two tooth elements. More particularly, the nose and socket arrangement is that shown and described in co-owned U.S. Pat. No. 4,335,532.

Teeth weighing 8 to 20 pounds are used on intermediate size rubber tired or track loaders. These typically have side locks usually of a steel and rubber sandwich design. The instant invention eliminates the need for separate lock costs and inventory and virtually eliminates the "knuckle busting" associated with installation and removal of side locks.

By the combination of the detent-like tongures which snap into companion recesses and the helical thread means interconnecting the nose and socket of the tooth elements, a point is now available which avoids the time consuming and laborious work of installation and removal. Now the imposition of negative thrust is incapable of pulling the point off the adapter because to do this, the removing force must also have a rotational component. More particularly, the detent means on the point and adapter is arranged and located to achieve locking engagement at the termination of the rotational movement of the point relative to the nose.

The invention also includes a novel means for securing the adapter element to the supporting portion of the excavator such as the bucket lip, etc. By virtue of utilizing uniquely contoured weld recesses in the confronting surfaces of the adapter, I am able to retain the adapter on its mounting irrespective of whether the weld fails or not—the unique contour developing an advantageous shear lock which prevents premature loss of the adapter. Welding, of course, has been used widely for many years in the securing of adapters to excavating machine lips and the like, as for example in U.S. Pat. No. 4,238,896. However, no one has appreciated the advantages of the contoured recess for establishing a continuous lock notwithstanding weld cracking.

Other objects and advantages of the invention may be seen in the details of the ensuing specification.

The invention is described in conjunction with the accompanying drawing, in which:

FIG. 1 is an exploded perspective view of one form of tooth incorporating teachings of the invention;

FIG. 2 is a view similar to FIG. 1 but viewed from the underside;

FIG. 3 is a view of the assembled components of the tooth seen in FIGS. 1 and 2;

FIG. 4 is an enlarged fragmentary sectional view showing the detent locking arrangement for securing the point and adapter in coupled relation;

Figure 12:
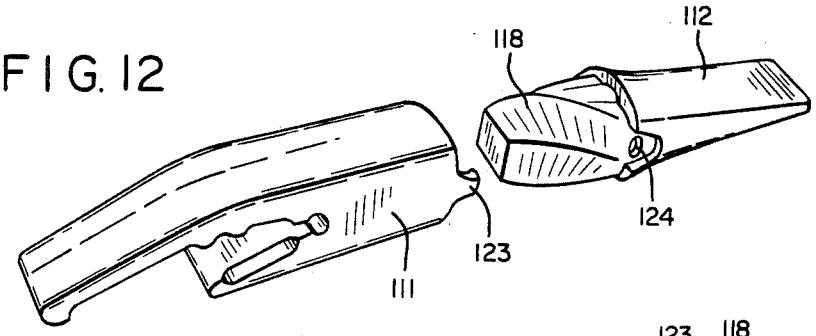
Figure 13:
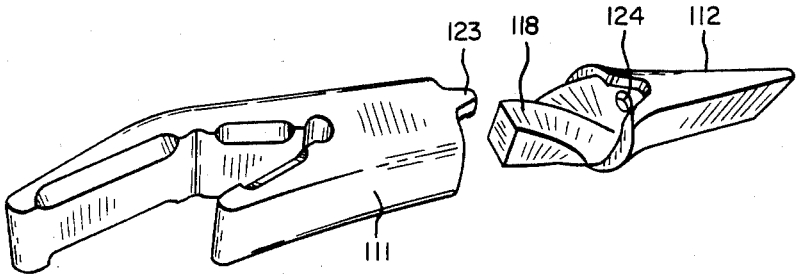
Figure 14:
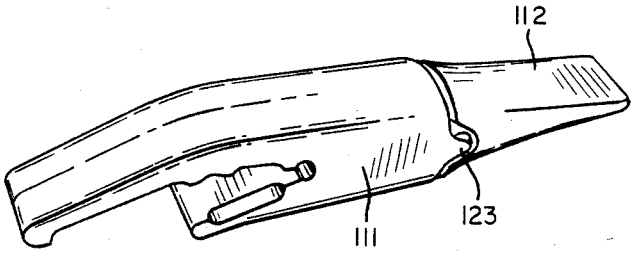
Figure 15:
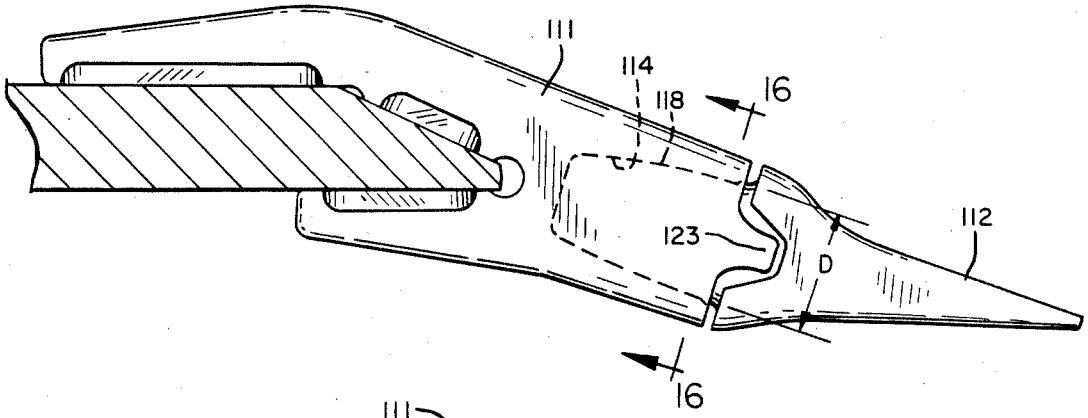
Figure 16:
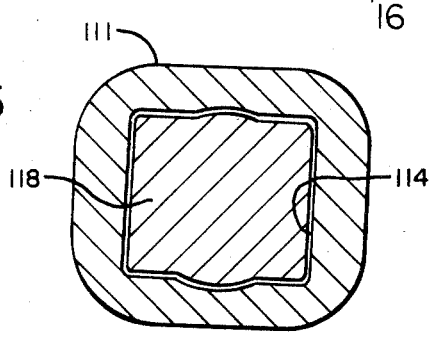

FIGS. 5 and 6 are sectional views taken along the sight lines 5—5 and 6—6, respectively as seen in FIG. 4;

FIG. 7 is a side elevational view of the point element of the preceding views;

FIG. 8 is a top plan view of the point element;

FIG. 9 is a fragmentary enlarged side elevational view af an adapter element mounted on the lip of the excavator which is seen only fragmentarily;

FIG. 10 is a top plan view of the adapter element of FIG. 9;

FIG. 11 is a sectional view taken along the sight line 11—11 as applied to FIG. 9;

FIG. 12 is an exploded perspective view seen essentially from above of a modified form of tooth incorporating teachings of the invention;

FIG. 13 is another perspective view of the disassembled tooth of FIG. 12 and corresponds in view essentially to that seen in FIG. 2;

FIG. 14 is a perspective view of the assembled point and adapter elements of the tooth seen in FIGS. 12 and 13;

FIG. 15 is a side elevational view of the assembly of FIG. 14 as installed on an excavating machine lip; and FIG. 16 is a sectional view taken along the sight line 16—16 of FIG. 15.

DETAILED DESCRIPTION

Referring to the drawing and first to FIGS. 1-3, the numeral 10 designates generally a tooth such as a trencher although the invention may be used to advantage in larger size teeth. The tooth includes an adapter 11 and a point 12.

The point 12 has a forwardly positioned earth engaging bit portion 13 and a rearwardly facing socket 14—see particularly FIG. 1.

The adapter is illustrated as a leg and one-half type—having upper and lower shank portions 15 and 16 which are intended to flank the upper and lower surfaces of the lip of an earthengaging bucket or the like. The forward fragment 17 of the lip is seen in FIG. 9.

At this forward portion, the adapter 11 is equipped with an integral nose 18—see particularly FIG. 1 constituting a coupling element. The nose 18 is constructed according to the teachings of co-owned U.S. Pat. No. 4,335,532 in that it is equipped with a plurality of helical thread means. I prefer to have the threads upstanding from the adjacent nose surfaces—as at 19 in FIG. 1. The socket 14 of the point 12 is the cooperative coupling element and is contoured to mate with the nose 18 and therefore the helical thread means therein are slots 20 interrupting the adjacent socket surfaces.

In the embodiment illustrated in FIGS. 1–11, the adapter nose 18 is further shaped to provide stabilizing surfaces—as at 21 for example in FIG. 1—adjacent the most forward portion or apex of the nose 18.

These are explained in greater detail in the above-mentioned '532 patent and reference may be had to that patent for additional details not set forth herein. Generally, however, the thread (or slot) forming sides merge into each other to provide a generally planar surface at 21 at the apex or distal end thereof. This is effective to resist the beam component of an applied force—any force applied to the point as at F in FIG. 2 being resolvable into beam and thrust quadrature components B and T, respectively.

The helical thread means constitute one part of the means for locking the point 12 on the adapter 11, the other part consisting of detent means generally designated 22 and best seen in FIG. 4. In the illustration, the detent means 22 includes rearwardly extending tongues 23 on the point 12 and mating recesses 24 on the sides of the adapter 11—see also FIG. 2.

OPERATION

In operation, the point 12 is installed on the adapter 11 by movement along the longitudinal axis of the tooth—the axis extending parallel to the thrust component T. Upon initial engagement of the socket 14 with the nose 18, a rotational movement is required for the point 12 as dictated by the helical thread means 19 and 20.

As the point 12 is moved more and more rearwardly—and just prior to the rear wall 25 (see FIG. 2) of the point 12 contacting the forward shoulder 26 (see FIG. 9) of the adapter 11, the tongues 23 snap into the recesses 24 in a detent-like action. More particularly, the shapes of the tongues and recesses are arranged to facilitate this snap-in action as the termination of the rotary relative movement.

For example, reference to FIG. 4 reveals that the rearward portion of the tongue 23 is enlarged as at 27 so as to enter into bearing engagement with the recess forward wall 28, as indicated by the opposed bearing arrows in the upper and lower left hand portions of FIG. 4. In the illustration given, the portions 27 are not only enlarged but project laterally inwardly, viz., toward the mounting axis A and thereby overlap the adjacent portion of the socket 14.

In like fashion, the recesses 24 project inwardly beyond the adjacent portions of the nose 18—compare, for example FIGS. 1 and 2 with FIG. 4. It will be appreciated, however, that in certain instances that the nose may not extend as far rearwardly as is illustrated at 28 in FIG. 9 in which case the recesses 23 can be positioned in the shoulder portion 29 of the adapter 11 and the enlarged portions 27 of the tongues 23 do not overlap the socket 14. In any event, the rearward portions of the tongues develop the detent or snap-in, hard to remove action of a detent. This may be enhanced by enlargements as illustrated or notching as at **23*a* at the remote or distal ends of the cantilever mounted integral tongues seen in FIGS. 7 and 8**. Irrespective to the tongue contour there is provided according to the invention an "easy-in, hold hard" type of operation characteristic of a detent.

The views on the second drawing sheet, FIGS. 7–11, more clearly delineate the helical thread means of the lock means and also bring out the structure responsible for advantageous weld attachment of the adapter 11 to the lip 17.

As mentioned previously relative to FIG. 9, the adapter has a shank consisting of upper and lower rearwardly extending legs 15 and 16 which flank and abut the upper and lower surfaces 30, 31 of the lip 17. The upper leg 15 has a bottom surface 32 which confronts the lip surface 30 and the lower leg 16 has a top surface 33 which confronts the lip surface 31. These can be quickly appreciated from the showing in FIG. 11.

Adjacent each longitudinally extending side as at 34 and 35, the upper and lower legs 15 and 16 are at the juncture of the confronting walls and the flanking side walls 34, 35. This arrangement is particularly advantageous in preventing deleterious results from weld failure. If, for example, a weld should fracture along the line 38 at the left hand portion of FIG. 9, any attempt of the adapter 11 to move forwardly, i.e., to the right in FIG. 9, is resisted by the shear-type engagement of the rear wall 40 of the associated space 36' with the remnant of the sheared weldment 38'. It will be appreciated that the cut-away portion may assume a variety of configurations in cross-section. The cut-away portion may be a straight bevel as illustrated or arcuate, viz., a J-shape in cross-section.

As illustrated, I provide weld-receiving spaces on both upper and lower legs 15 and 16 so as to develop weld fragments upon failure at a plurality of locations to maintain the adapter on the lip until looseness is noted by the operator and repair instituted. In the past, weld failure resulted in almost immediate detachment of the adapter from the lip and unless the operator noticed the same, the next pass of the shovel or dipper could seriously damage the lip. When lip damage occurs, a major repair is in order because the lip normally is not conveniently detachable from the remainder of the excavator.

ALTERNATIVE EMBODIMENT

Turning now to the third drawing sheet which includes FIGS. 12–16, a modified form of the invention is depicted. The essential differences between the showings of FIGS. 1–11 and that of FIGS. 12–16 lies in the provision of the nose 118 on the point 112 while the socket 114 is provided in the adapter 111. In like fashion, the tongues 123 and recesses 124 are in reversed positions—see FIG. 13.

This reversal of the coupling elements not only achieves the same benefits of the sequential lock described in connection with the rotation and snap-in arrangement of FIGS. 1–11 but provides a further benefit in terms of greater strength or resistance to beam loads.

For example, the beam loading in the embodiment of FIGS. 1–11 is effectively concentrated on the tip or apex of the nose 18, i.e., on the stabilizing surfaces 21. These are separated a discrete distance d as can be seen from FIG. 7. With an identically contoured and shaped nose 118 provided on the point 112, the beam loadings—the significant forces B to be resisted in excavation because the positive thrust forces T operate against the strongest part of the excavator—now operate on a much deeper section D (see FIG. 15) at the proximal end thereof. The importance of this difference can be appreciated from the fact that resistance to beam loading varies according exponentially to the depth or thickness, viz., $R=(bd^2/6.)$ This means that for a given nose size, substantially greater strength is available. This also means that for a given design strength—normally termed "breakout force", the nose 118 of the FIG. 12 embodiment can be much smaller than the nose 18 of FIG. 1 because the force is resisted by the larger proximal end than the smaller distal end. This becomes significant when it is considered that from 5 to 10 and sometimes 20 points are replaced before a given adapter is worn to replacement level. Heretofore, the art workers, being cognizant of this fact, have tried to reduce the amount of throw-away metal when the point has worn out. Therefore, almost without exception since World War II the commercial teeth have had socketed points. Now, for the first time there is a reversal of that trend. It is only after extensive field experince with what might be considered a "solid" point or tooth that additional benefits may be appreciated. How these may accrue is not totally predictable at this time, but it is expected that they will occur because of the higher strength to weight ratio in this embodiment.

While in the foregoing specification a detailed description of the invention has been set down for illustration, many variations in these details may be made without departing from the spirit and scope of the invention.

I claim:

1. An excavating tooth for trenching or the like comprising an adapter member and a point member, a nose equipped with helical thread means on one member and a nose-conforming socket on the other member also equipped with helical thread means, said point member being rotatably mounted on said adapter member by movement along a longitudinal axis, said socket-equipped member being equipped with a pair of lateral tongues projecting longitudinally away from said socket, said nose member being equipped with a pair of recesses aligned with said tongues when said point member is installed on said adapter member, each of said tongues having an inner surface adapted to develop detent engagement with said recesses upon installation, said tongues being deflected as said point member is driven onto said adapter so that said inner surfaces snap into said recesses when said point member is fully installed on said adapter member, said tongues, recesses and helical thread means being the sole means securing said point member to said adapter member.

2. The tooth of claim 1 in which said point member is equipped with said nose.

3. The tooth of claim 1 in which said tongues are enhanced at their distal ends to provide said detent engagement upon substantial completion of relative rotary movement between said members.

4. The tooth of claim 1 in which said point member is equipped with said socket.

5. The tooth of claim 4 in which said tongues each overlap said socket in their distal portions.

6. A point member for an excavating tooth comprising a relatively elongated unitary body having a ground engaging end and a mounting end, said point member adjacent said ground engaging end having top, bottom and side walls, said point member adjacent said mounting end having a coupling element equipped with helical thread means for coupling with the correspondingly contoured coupling element of an adapter member, each of said side walls adjacent said coupling element being equipped with detent means for detent engagement with a correspondingly contoured detent means on said adapter member, said detent means on said point member and said adapter member including tongues on one member and recesses on the other member, said tongues each having an inner surface adapted to develop detent engagement upon installation of said point member upon said adapter member, said tongues being deflected as said point member is driven onto said adapter so that said inner surfaces snap into said recesses when said point member is fully installed on said adapter member, said tongues, recesses and helical thread means being the sole means securing said point member to said adapter member.

7. The point member of claim 6 in which said tongues are enhanced at their distal ends to provide said detent engagement upon substantial completion of relative rotary movement between said members.

8. The point member of claim 7 in which said point member is equipped with a socket constituting said coupling element.

9. The point member of claim 7 in which said point member is equipped with a nose constituting said coupling element.

10. The point member of claim 6 in which said point member is equipped with a nose constituting said coupling element, said nose being contoured to provide stabilizing surfaces at the distal end thereof, said proximal end having a dimension resistive to beam loading of the order of that provided at the distal end of a nose in a socket-type point.

11. An excavating tooth for trenching or the like comprising an adapter and a point, a nose equipped with helical thread means on said adapter and a nose-conforming socket in said point also equipped with helical thread means, said point being rotatably mounted on said adapter by movement along a longitudinal axis, said point being equipped with a pair of lateral tongues projecting longitudinally away from said socket, said adapter being equipped with a pair of recesses aligned with said tongue when said point is installed on said adapter, each of said tongues having an inner surface adapted to develop detent engagement with said recesses, said tongues being deflected as said point is driven onto said adapter so that said inner surfaces snap into said recesses when said point is fully installed on said adapter, said tongues, recesses and helical thread means being the sole means securing said points to said adapter.

12. A point for an excavating tooth comprising a relatively elongated unitary body having a ground engaging end and a mounting end, said point adjacent said ground engaging end having a top, bottom and side walls, said point adjacent said mounting end having a socket equipped with helical thread means for coupling with the correspondingly contoured nose of an adapter, each of said side walls adjacent said mounting end being equipped with a pair of lateral tongues projecting longitudinally away from the said socket for detent engagement with recesses on the sides of said adapter, each of said tongues having an inner surface adapted to develop the detent engagement with said recesses, said tongues being adapted to be deflected as said point is driven onto said adapter so that said inner surfaces snap into said recesses when said point is fully installed on said adapter, said tongues, recesses and helical thread means being the sole means securing said point to said adapter.

* * * * *